US006674981B2

(12) United States Patent
Sugimoto

(10) Patent No.: US 6,674,981 B2
(45) Date of Patent: Jan. 6, 2004

(54) IMAGE FORMING APPARATUS WITH SHEET SIZE AND SHAPE DETECTION

(75) Inventor: Shinya Sugimoto, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/047,034

(22) Filed: Jan. 17, 2002

(65) Prior Publication Data

US 2003/0133734 A1 Jul. 17, 2003

(51) Int. Cl.[7] ..... G03G 15/00
(52) U.S. Cl. ..... 399/81; 399/376; 399/389
(58) Field of Search ..... 399/45, 389, 370, 399/376, 81; 271/171; 355/75; 358/449

(56) References Cited

U.S. PATENT DOCUMENTS 5,581,344 A * 12/1996 Makita ..... 399/45
5,722,029 A * 2/1998 Tomidokoro et al. ..... 399/389

FOREIGN PATENT DOCUMENTS

| | | | |
|---|---|---|---|
| JP | 6-0239492 A | * | 8/1994 |
| JP | 7-191420 | | 7/1995 |
| JP | 7-228385 A | * | 8/1995 |
| JP | 8-202214 A | * | 8/1996 |
| JP | 2000-72265 A | * | 3/2000 |

* cited by examiner

*Primary Examiner*—Joan Pendegrass
(74) *Attorney, Agent, or Firm*—Foley & Lardner

(57) ABSTRACT

When a menu of "SHEET SIZE SETTING" is chosen, a main CPU scans a non-fixed-sized sheet once, and takes in a scanned image. Based on the taken-in image, the main CPU detects the size of the sheet and sets the sheet size of a selected sheet cassette. The main CPU controls image formation using the non-fixed-sized sheet set in the sheet cassette.

8 Claims, 6 Drawing Sheets

IMAGE FORMING APPARATUS WITH SHEET SIZE AND SHAPE DETECTION

BACKGROUND OF THE INVENTION

The present invention relates to an image forming apparatus such as a digital copying machine wherein an image on an original is scanned by a scanner and printed out on paper by a printer.

In conventional digital copying machines, there are the following methods of detecting sheet sizes of paper sheets to be fed from sheet cassettes at the time of image formation:

(1) The user chooses one of sizes displayed on an operation panel of a digital copying machine.

(2) A sheet size detection mechanism is provided in a sheet cassette. In an example of the detection mechanism, the positions of side guides and end guides, which are made to match with a paper sheet, are detected stepwise.

In the case of (1), although the cost is low because the detection mechanism is not provided, it is inconvenient that the user has to input the sheet size.

In the case of (2), the machine body cost is high because the detection mechanism is required. Moreover, only fixed sizes can automatically be detected. The number of automatically detectable sizes is limited. When the size varies on the order of mm, as in the case of non-fixed sizes, input or setting is required.

Specifically, in either of the cases (1) and (2), when a paper sheet is of a non-fixed size, there is a problem that the user has to input or set the sheet size on the operation panel.

BRIEF SUMMARY OF THE INVENTION

The object of the present invention is to provide an image forming apparatus capable of detecting and setting a sheet size, without increasing a machine body cost or imposing a load on a user.

This invention may provide an image forming apparatus having a plurality of cassettes for containing paper sheets, and forming an image on a paper sheet fed from one of the cassettes, the apparatus comprising: a designating section which designates the cassette in which a paper sheet for image formation by the image forming apparatus is to be set; an image read section which reads an image of the paper sheet to be set in the cassette designated by the designating section, when the paper sheet is placed on an original table; and a control section which executes a control to detect the size of the paper sheet on the basis of the image read by the image read section.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
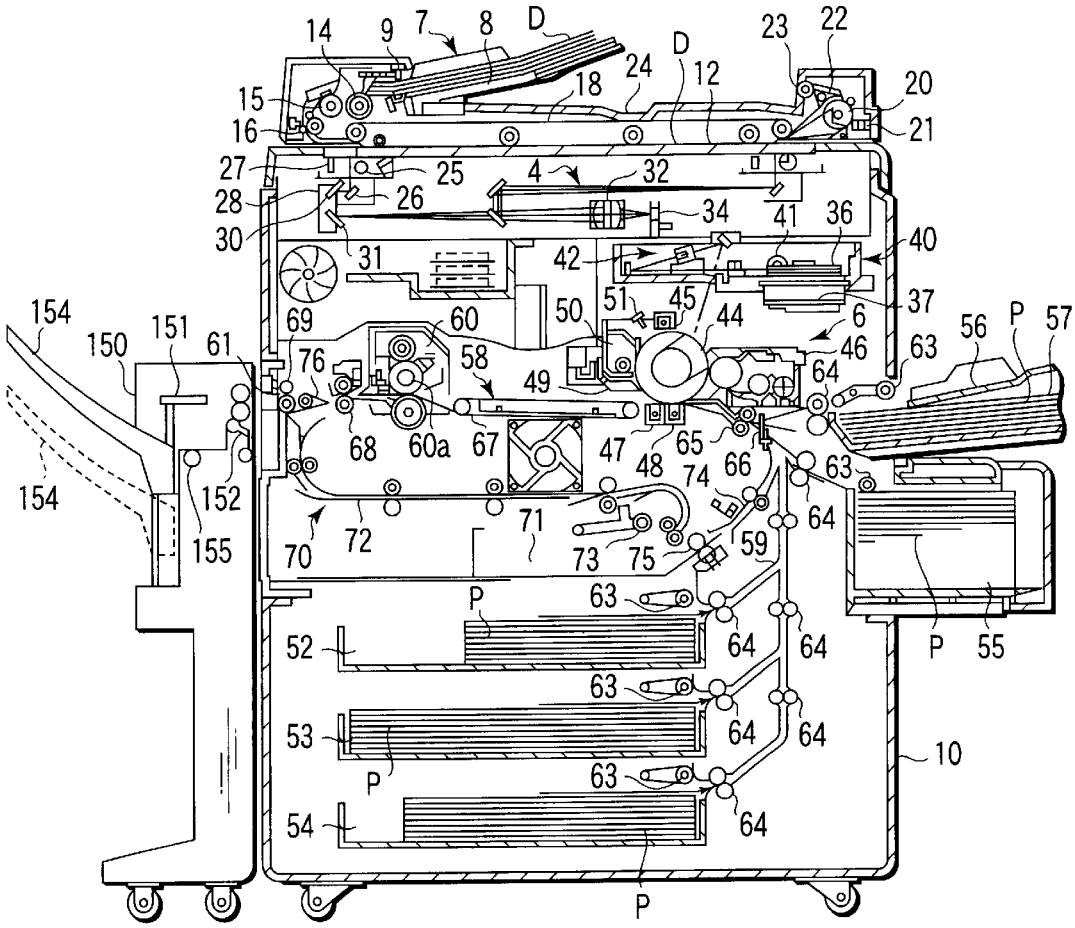
FIG. 1 is a cross-sectional view showing an internal structure of a digital copying machine according to an image forming apparatus of the present invention.

FIG. 1 is a cross-sectional view showing an internal structure of a digital copying machine (DPPC) according to an image forming apparatus of the present invention.

In FIG. 1, the digital copying machine has an apparatus main body 10. The apparatus main body 10 incorporates a scanner section 4 functioning as an image read section and a printer section 6 functioning as an image forming section.

An original table 12 formed of transparent glass, on which a read object, i.e. an original D is placed, is disposed on the upper surface of the apparatus main body 10. An automatic document feeder 7 (hereinafter referred to as "ADF") for automatically feeding originals D onto the original table 12 is disposed on the upper surface of the apparatus main body 10. The ADF 7 is disposed to be opened/closed with respect to the original table 12 and serves as an original cover for bringing the original D placed on the original table 12 into close contact with the original table 12.

The ADF 7 has an original tray 8 on which the original D is set; an empty sensor 9 for detecting the presence/absence of originals; pickup rollers 14 for picking up originals on the original tray 8 one by one; a feed roller 15 for conveying the picked-up original; an aligning roller pair 16 for aligning the leading edges of the originals; and a conveyor belt 18 disposed to cover almost the entire surface of the original table 12. A plurality of originals set on the original tray 8 with their surfaces facing up are sequentially taken out from the lowermost page, i.e. the last page, aligned by the aligning roller pair 16, and conveyed to a predetermined position on the original table 12 by the conveyor belt 18.

In the ADF 7, a reversing roller 20, a non-reverse sensor 21, a flapper 22 and a delivery roller 23 are disposed at the end portion on the opposite side of the aligning roller pair 16 with respect to the conveyor belt 18. The original D whose image information has been read by a scanner section 4 (to be described later) is fed from the original table 12 by the conveyor belt 18 and delivered to an original delivery section 24 on the ADF 7 through the reversing roller 20, flapper 21 and delivery roller 22. To read the lower surface of the original D, the flapper 22 is switched. The original D conveyed by the conveyor belt 18 is reversed by the reversing roller 20 and fed to a predetermined position on the original table 12 again by the conveyor belt 18.

The scanner section 4 provided in the apparatus main body 10 has an exposure lamp 25 as a light source for illuminating the original D placed on the original table 12, and a first mirror 26 for deflecting reflection light from the original D in a predetermined direction. The exposure lamp 25 and first mirror 26 are attached to a first carriage 27 disposed under the original table 12.

The first carriage 27 is disposed to be movable in parallel to the original table 12 and reciprocally moved under the original table 12 by a scanning motor through a toothed belt (not shown), etc.

A second carriage 28 movable in parallel to the original table 12 is disposed under the original table 12. Second and third mirrors 30 and 31 for successively deflecting reflection light from the original D, which has been deflected by the first mirror 26, are attached to the second carriage 28 at right angles with each other. The second carriage 28 is moved by, e.g. the toothed belt for driving the first carriage 27 along with the first carriage 27, and moved in parallel along the original table 12 at half the speed of the first carriage.

A focusing lens 32 for focusing reflection light from the third mirror 31 mounted on the second carriage 28, and a CCD (photoelectric conversion element) 34 for receiving the reflected light focused by the focusing lens and photoelectrically converting it are also disposed under the original table 12. The focusing lens 32 is disposed in a plane including the optical axis of the light deflected by the third mirror 31 so as to be movable by means of a driving mechanism. The focusing lens 32 moves to focus the reflection light at a desired magnification. The CCD 34 photoelectrically converts the incoming reflection light and outputs an electrical signal corresponding to the read original D.

On the other hand, the printer section 6 has a laser exposure unit 40 functioning as a latent image forming means. The laser exposure unit 40 comprises a semiconductor laser 41 as a light source; a polygon mirror 36 as a scanning member for continuously deflecting a laser beam emitted by the semiconductor laser 41; a polygon motor 37 as a scanning motor for rotatably driving the polygon mirror 36 at a predetermined rotational speed; and an optical system 42 for deflecting the laser beam from the polygon mirror 36 and guiding the beam to a photosensitive drum 44 (to be described later). The laser exposure unit 40 with the above structure is fixed to a support frame (not shown) of the apparatus main body 10.

The semiconductor laser 41 is ON/OFF-controlled in accordance with the image information of the original D read by the scanner section 4 or facsimile transmission/reception document information. The laser beam is directed to the photosensitive drum 44 through the polygon mirror 36 and optical system 42 to scan the outer surface of the photosensitive drum 44, thereby forming an electrostatic latent image on the outer peripheral surface of the photosensitive drum 44.

The printer section 6 has the rotatable photosensitive drum 44 as an image carrier disposed almost at the center of the apparatus main body 10. The outer peripheral surface of the photosensitive drum 44 is exposed to the laser beam from the laser exposure unit 40, and so a desired electrostatic latent image is formed thereon. Around the photosensitive drum 44, the following elements are arranged in the named order: a charger 45 for electrifying the outer peripheral surface of the drum 44 with a predetermined charge; a developing device 46 for supplying toner as a developer to the electrostatic latent image formed on the outer peripheral surface of the photosensitive drum 44 to develop it at a desired image density; a transfer charger 48, which integrally includes a separation charger 47 for separating an image formation medium, i.e. a paper sheet P, fed from a paper cassette (to be described later) from the photosensitive drum 44, and transfers the toner image formed on the photosensitive drum 44 onto the paper sheet P; a separation gripper 49 for separating the paper sheet P from the outer peripheral surface of the photosensitive drum 44; a cleaning unit 50 for removing toner remaining on the outer peripheral surface of the photosensitive drum 44; and a charge erase device 51 for erasing charge on the outer peripheral surface of the photosensitive drum 44.

An upper sheet cassette 52, a middle sheet cassette 53 and a lower sheet cassette 54 which can be drawn out of the apparatus main body 10 are stacked at the lower portion of the apparatus main body 10. These cassettes 52 to 54 store paper sheets P of different sizes. A large-capacity feeder 55 is disposed on one side of these cassettes. This large-capacity feeder 55 stores about 3,000 paper sheets P having a size with high use frequency, e.g. paper sheets P with A4 size. A feed cassette 57 also serving as a manual feed tray 56 is detachably attached above the large-capacity feeder 55.

A convey path 58 extending from the sheet cassettes and large-capacity feeder 55 through a transfer section located between the photosensitive drum 44 and transfer charger 48 is formed in the apparatus main body 10. A fixing unit 60 having a fixing lamp 60*a* is disposed at the end of the convey path 58. A delivery port 61 is formed in the side wall of the apparatus main body 10, which is opposed to the fixing unit 60. A single-tray finisher 150 is attached to the delivery port 61.

Pickup rollers 63 for taking out the paper sheets P one by one from the sheet cassette 52, 53, 54, 57 or large-capacity feeder 55 are arranged near each of the upper sheet cassette 52, middle sheet cassette 53, lower sheet cassette 54 and feed cassette 57 and near the large-capacity feeder 55. A number of feed roller pairs 64 for conveying the paper sheet P taken out by the pickup rollers 63 through the convey path 58 are arranged in the convey path 58.

A registration roller pair 65 is arranged in the convey path 58 on the upstream side of the photosensitive drum 44. The registration roller pair 65 corrects a tilt of the extracted paper sheet P, registers the leading edge of the toner image on the photosensitive drum 44 and the leading edge of the paper sheet P, and feeds the paper sheet P to the transfer section at the same speed as the speed of movement of the outer peripheral surface of the photosensitive drum 44. A pre-aligning sensor 66 for detecting arrival of the paper sheet P is provided in front of the registration roller pair 65, i.e. on the feed roller 64 side.

Each paper sheet P extracted one by one from the sheet cassette, 52, 53, 54, 57 or large-capacity feeder 55 by the pickup rollers 63 is fed to the registration roller pair 65 by the feed roller pair 64. After the leading edge of the paper sheet P is aligned by the registration roller pair 65, the paper sheet P is fed to the transfer section.

In the transfer section, a developer image, i.e. toner image formed on the photosensitive drum 44 is transferred onto the paper sheet P by the transfer charger 48. The paper sheet P on which the toner image has been transferred is separated from the outer peripheral surface of the photosensitive drum 44 by the function of the separation charger 47 and separation gripper 49 and conveyed to the fixing unit 60 through a conveyor belt 67 constituting part of the convey path 58. After the developer image is melted and fixed on the paper sheet P by the fixing unit 60, the copying paper sheet P is delivered onto the finisher 150 through the delivery port 61 by a feed roller pair 68 and a delivery roller pair 69.

An automatic double-side unit 70 for reversing the paper sheet P which has passed through the fixing unit 60 and feeding it to the registration roller pair 65 again is provided under the convey path 58. The automatic double-side unit 70 comprises a temporary stack 71 for temporarily stacking the paper sheets P; a reversing path 72 branched from the convey path 58 to reverse the paper sheet P which has passed through the fixing unit 60 and to guide the paper sheet P to the temporary stack 71; pickup rollers 73 for extracting the paper sheets P stacked on the temporary stack one by one; and a feed roller 75 for feeding the extracted paper sheet P to the registration roller pair 65 through a convey path 74. A selector gate 76 for selectively distributing the paper sheets P to the delivery port 61 or reversing path 72 is provided at the branch portion between the convey path 58 and reversing path 72.

Where double-copying is performed, the paper sheet P which has passed through the fixing unit 60 is guided to the reversing path 72 by the selector gate 76, temporarily stacked on the temporary stack 71 in a reversed state, and fed to the registration roller pair 65 through the convey path 74 by the pickup rollers 73 and feed roller 75. The paper sheet P is registered by the registration roller pair 65 and fed to the transfer section again to transfer a toner image onto the reverse surface of the paper sheet P. Thereafter, the paper sheet P is delivered to the finisher 150 through the convey path 58, fixing unit 60 and delivery rollers 69.

The finisher 150 staples delivered copies of documents and stores them in units of a copy. Each time a paper sheet P to be stapled has been delivered from the delivery port 61, a guide bar 151 aligns the paper sheet P to the stapling side. When all paper sheets have been delivered, a copy of paper sheets P is pressed by a paper press arm 152 and stapled by a stapler unit (not shown). Then the guide bar 151 moves downward. The stapled paper sheets P are delivered to a finisher delivery tray 154 by a finisher delivery roller 155 in units of a copy. The downward movement amount of the finisher delivery tray 154 is roughly determined in accordance with the number of paper sheets P to be delivered, and the finisher delivery tray 154 moves downward stepwise every time one copy is delivered. The guide bar 151 for aligning the delivered paper sheets P is located at such a high position that the guide bar 151 may not abut upon the already stapled paper sheets P placed on the finisher delivery tray 154.

The finisher delivery tray 154 is connected to a shift mechanism (not shown) which shifts (e.g. in four directions: front, rear, left and right sides) in units of a copy in the sort mode.

An operation panel 80 for inputting various copy conditions, a copy start signal for starting copying operations, etc. is provided at the upper portion on the front side of the apparatus main body 10.

Figure 2:
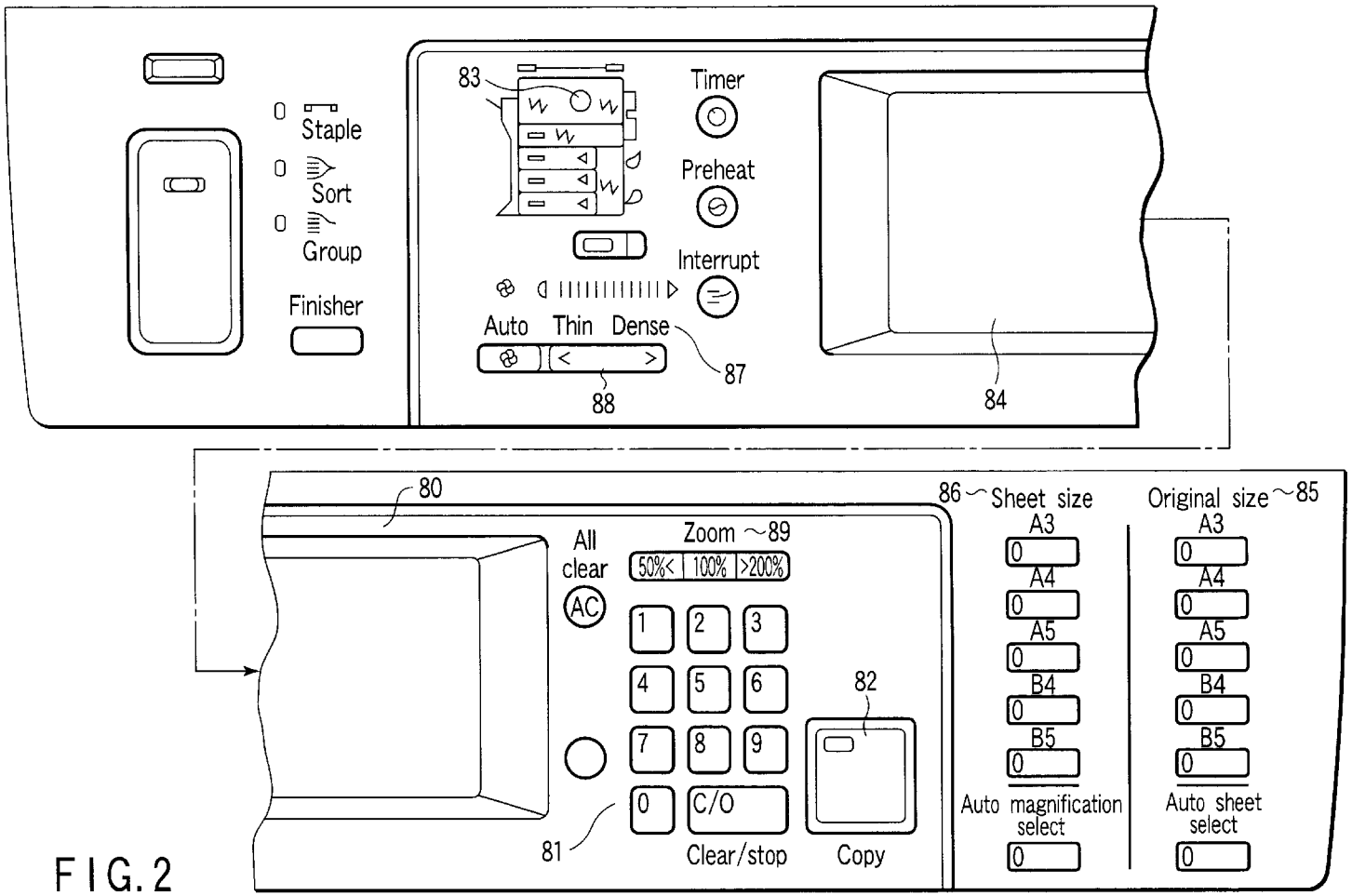
FIG. 2 is a plan view showing the structure of an operation panel.

As is shown in FIG. 2, the operation panel 80 comprises numeral keys 81, a copy key 82, a state display section 83, a liquid crystal display section 84, an original size setting key 85, a sheet size setting key 86, a density display section 87, a density setting key 88, and a magnification setting key 89.

The numeral keys 81 are used to set the number of originals, or the number of copies.

The copy key 82 is used to instruct the start of copying.

The state display section 83 displays guidance on the state of selection of the sheet feed cassette, jamming of an original or a paper sheet, etc.

The liquid crystal display section 84 displays the number of originals and the number of copies, and also displays the copying magnification, editing, and various operational guidances. The liquid crystal display section 84 is provided with a touch panel, which enables input of various operational instructions, such as input by selection keys. For example, it displays selection keys for a photo mode, a character mode and a character/photo mode as original modes, and permits input thereof.

The original size setting key 85 is used to set the size of the original D.

The sheet size setting key 86 is used to set the size of the sheet P.

The density display section 87 displays the copy density set by the density setting key 88.

Figure 3:
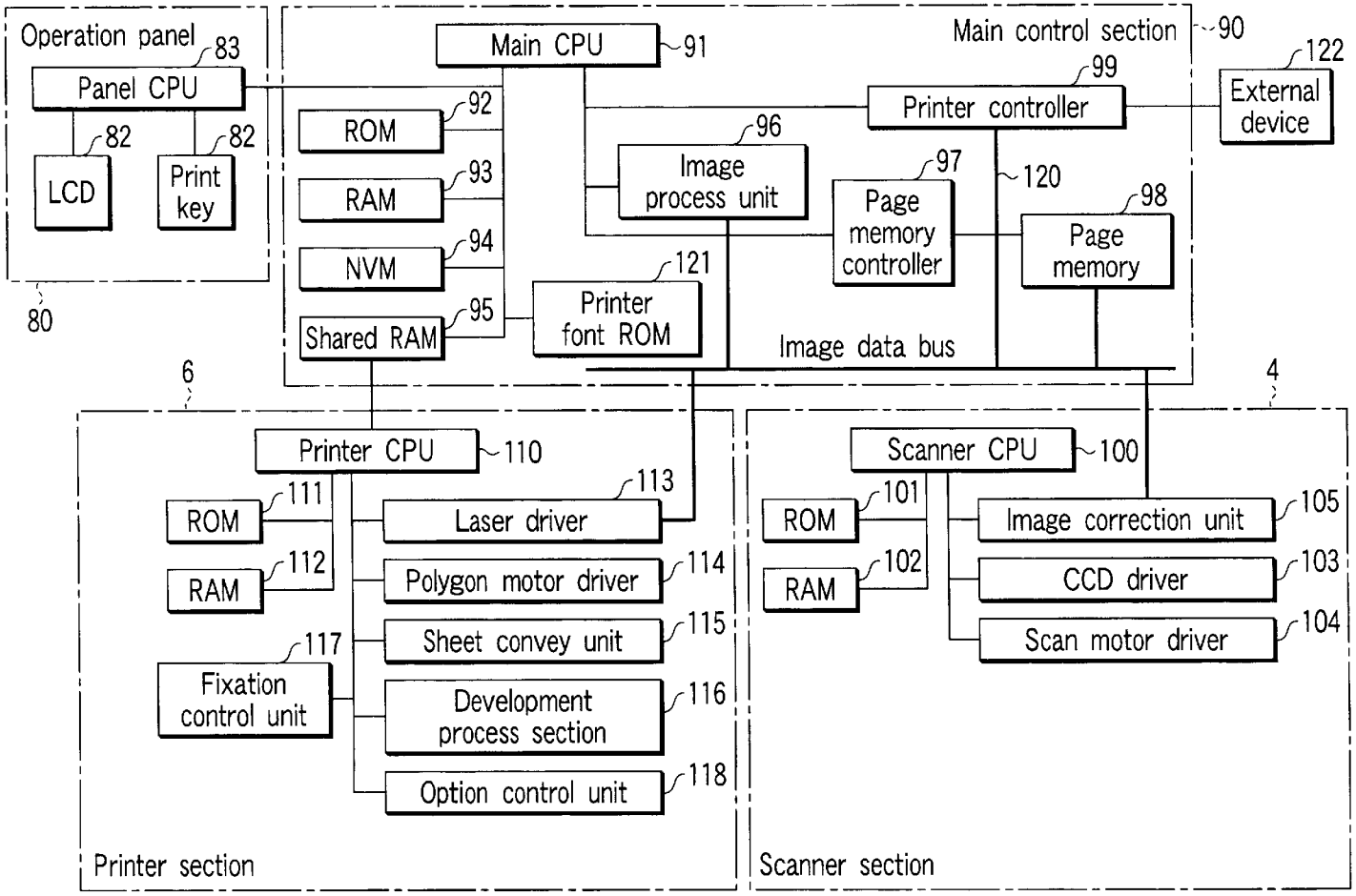
FIG. 3 is a block diagram schematically showing the structure of the digital copying machine.

FIG. 3 is a block diagram schematically showing electrical connection of the digital copying machine shown in FIG. 1 and flow of signals for control. In FIG. 3, a control system comprises three CPUs: a main CPU 91 provided in a main control section 90; a scanner CPU 100 in the scanner section 4; and a printer CPU 110 in the printer section 6. The main CPU 91 performs bidirectional communication with the printer CPU 110 via a shared RAM 95. The main CPU 91 issues an operational instruction, and the printer CPU 110 returns status data. Serial communication is performed between the printer CPU 110 and scanner CPU 100. The printer CPU 110 issues an operational instruction, and the scanner CPU 100 returns status data.

The operation panel 80 is connected to the main CPU 91.

The main control section 90 comprises the main CPU 91, a ROM 92, a RAM 93, an NVRAM 94, a shared RAM 95, an image processing unit 96, a page memory control unit 97, a page memory 98, a printer controller 99, and a printer font ROM 121.

The main CPU 91 controls the entirety of the main control section 90. The ROM 92 stores control programs, etc. The RAM 93 temporarily stores various data.

As will be described later, the ROM 92 stores control programs for reading an image on a paper sheet and detecting the size of the sheet from the image.

The NVM (Non-Volatile RAM) 94 is a non-volatile memory backed up by a battery (not shown). Even when power is not supplied to the NVM 94, stored data is maintained.

The shared RAM 95 is used to perform bidirectional communication between the main CPU 91 and printer CPU 110.

The page memory controller 97 stores and reads out image information in and from the page memory 98. The page memory 98 has areas capable of storing image information of a plurality of pages. The page memory 98 can store compressed data in units of a page, which is obtained by compressing image information from the scanner section 4.

In addition, a compression section 87 for compressing image data is connected to the page memory controller 97.

The printer font ROM 121 stores font data corresponding to print data.

The printer controller 99 develops print data, which is sent from an external device 122 such as a personal computer, into image data using the font data stored in the printer font ROM 121 with a resolution corresponding to resolution data added to the print data.

The scanner section 4 comprises the scanner CPU 100 for controlling the entirety of the scanner section 4; a ROM 101 storing control programs, etc.; a data storage RAM 102; a CCD driver 103 for driving the CCD sensor 34; a scan motor driver 104 for controlling the rotation of a scan motor for moving the exposure lamp 25, mirrors 26, 27 and 28, etc.; and an image correction unit 105. The image correction section 105 comprises an A/D converter for converting analog signals output from the CCD sensor 34 to digital signals; a shading correction circuit for correcting a variance in the CCD sensor 34, or a variation in threshold level due to ambient temperature variation relative to the output signal from the CCD sensor 34; and a line memory for temporarily storing shading-corrected digital signals from the shading correction circuit.

The printer section 6 comprises the printer CPU 110 for controlling the entirety of the printer section 6; a ROM 111 storing control programs, etc.; a data storage RAM 112; a laser driver 113 for driving the semiconductor laser 41; a polygon motor driver 114 (motor control device) for controlling the rotation of the polygon motor 37 of the laser exposure unit 40; a sheet convey unit 115 for controlling conveyance of the sheet P by the convey mechanism 58; a process control section 116 for controlling charging, developing and transferring processes using the charging device 45, developing device 46 and transfer charger 48; a fixation control unit 117 for controlling the fixing device 60; and an option control unit 118 for control options.

The image process section 96, page memory 98, printer controller 99, image correction section 105, and laser driver 113 are connected over an image data bus 120.

Figure 4:
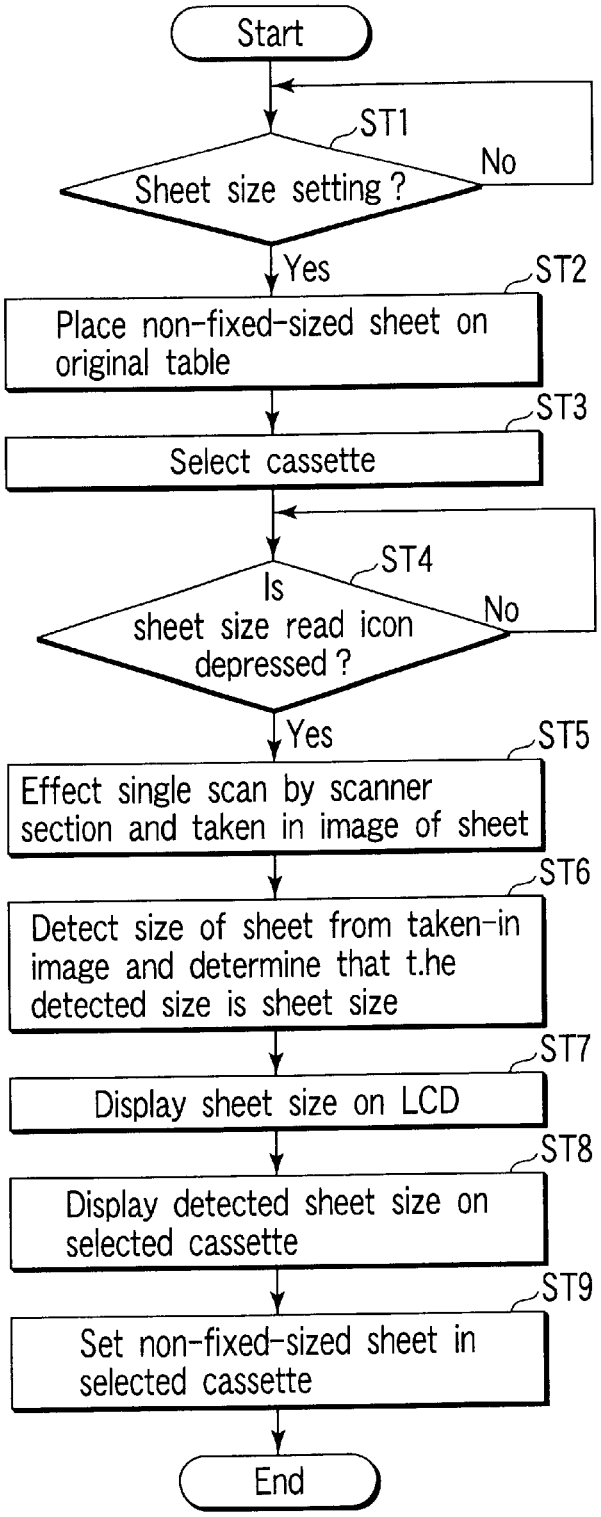
FIG. 4 is a flow chart illustrating a non-fixed-sized sheet setting operation.

The operation of setting a paper sheet of a non-fixed size in the above structure will now be described with reference to a flow chart of FIG. 4.

Assume that a non-fixed-sized paper sheet, on which an image is to be formed, is set in the digital copying machine shown in FIG. 1.

The user chooses "SHEET SIZE SETTING" on a menu displayed on the liquid crystal display 84 of operation panel 80 (ST1).

The user places the non-fixed-sized sheet on the original table 12 or the original tray 8 of ADF 7 (ST2). Assume that the sheet has been placed on the original table 12.

The user depresses the sheet size setting key 86 on the operation panel 80, and chooses the cassette in which the sheet is to be set (ST3). Assume that the middle cassette 53, for instance, has been chosen.

The user depresses the sheet size read icon in the liquid crystal display section 84.

When the sheet size read icon in the liquid crystal display section 84 has been depressed (ST4), the main CPU 91 causes the scanner section 4 to scan the sheet once. The image on the sheet is read and stored in the page memory 98 (ST5). In order to detect the sheet size, it is necessary that a difference in density be present between the sheet and the area outside the sheet. Thus, when the sheet is placed on the original table 12, the ADF 7 serving as the original holder is opened.

When the ADF 7 is used, the color of the convey belt of the ADF 7 should preferably be made different from the color of the sheet.

The main CPU 91 detects the size of the area occupied by the sheet on the basis of the image stored in the page memory 98, and determines that the detected size is the size of the sheet to be set in the middle cassette 53 (ST6). Of course, if the detected size is a fixed size, the detected size is set as a fixed size.

The main CPU 91 causes the liquid crystal display section 84 of operation panel 80 to display the sheet size of the middle cassette 53 (ST7).

Figure 5:
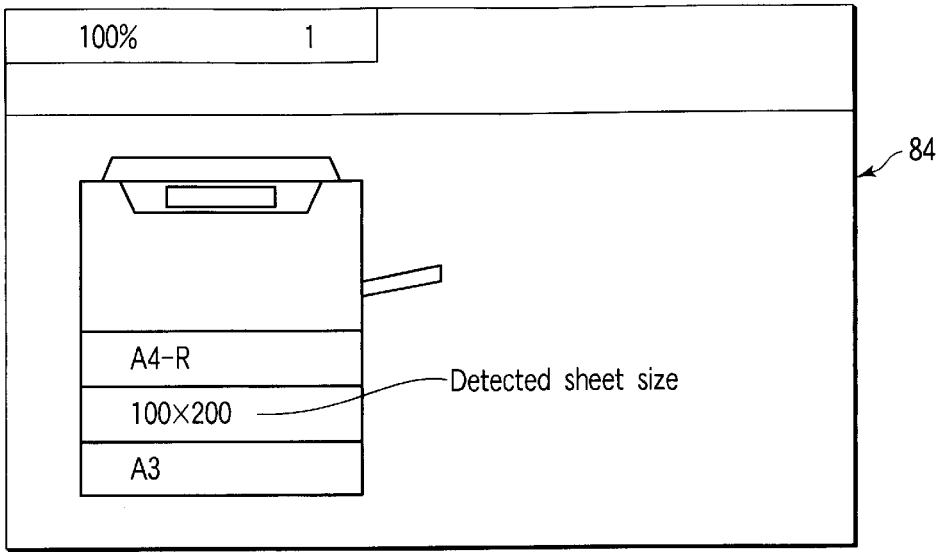
FIG. 5 shows an example in which a sheet size is displayed on a liquid crystal display section.

FIG. 5 shows an example in which the sheet size is displayed on the liquid crystal display section 84. The detected sheet size, e.g. 100 mm×200 mm, is displayed at the position of the displayed cassette corresponding to the middle cassette 53 on the displayed general structure of the apparatus.

Figure 6:
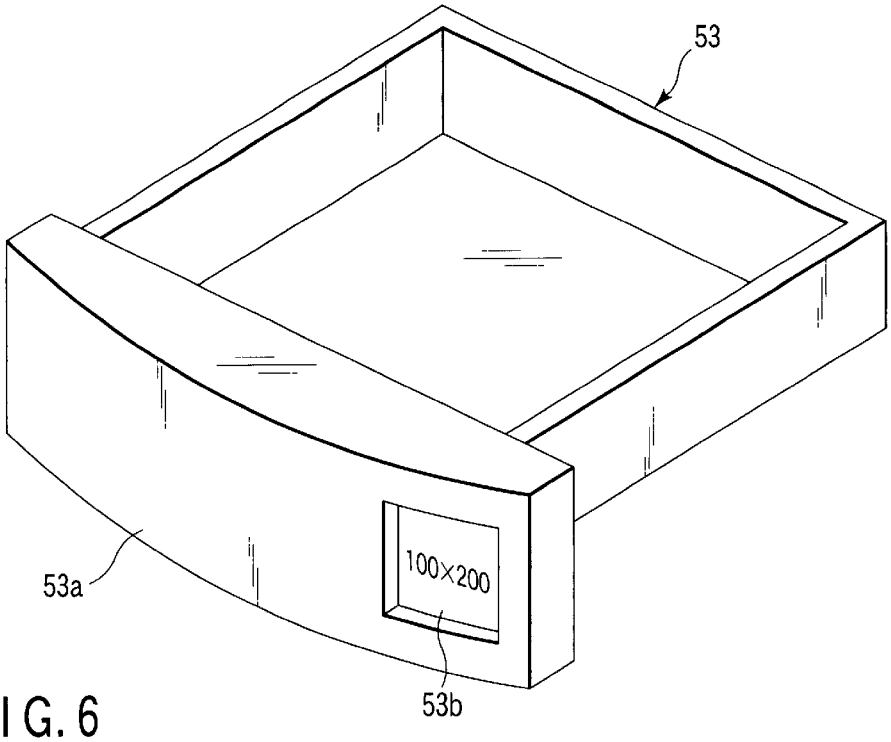
FIG. 6 shows an external structure of an example in which a sheet size is displayed on the cassette.

FIG. 6 shows an external structure of the middle cassette 53. A liquid crystal display **53*b* is provided on the right side of the front face of a cassette cover 53*a* of middle cassette 53. The main CPU 91 causes the liquid crystal display section 53*b*** to display the detected sheet size, e.g. 100 mm×200 mm (ST8).

At last, the non-fixed-sized sheet is set in the middle cassette 53 (ST9). Thus, an image can be formed on the non-fixed-sized sheet.

The middle cassette 53 has the same external structure as the upper cassette 52 and lower cassette 54.

Applied examples of the present invention will now be described.

In this invention, not only the sheet size but also the sheet shape can be detected. For example, a non-rectangular shape such as the shape of a tab sheet can be detected.

Figure 7:
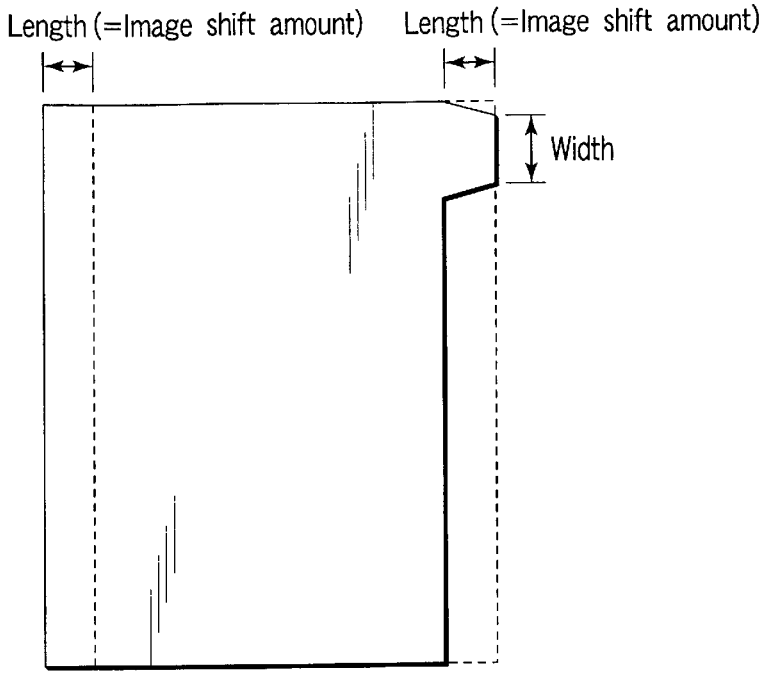
FIG. 7 shows an example of a tab sheet.

FIG. 7 shows an example of a tab sheet.

In the case of the tab sheet shown in FIG. 7, the size (length, width) of a tab portion has to be specified in order to effect printing on the tab portion.

In the prior art, when an image is shifted by a length of the tab portion, the user sets the amount of image shifting.

In the present invention, based on the read image of the tab sheet shown in FIG. 7, the main CPU 91 causes the liquid crystal display section 84 to display the image shape (to be reduced) and can detect the size of the tab portion. Thereby, printing can be effected on the tab portion without time-consuming setting.

Figure 8:
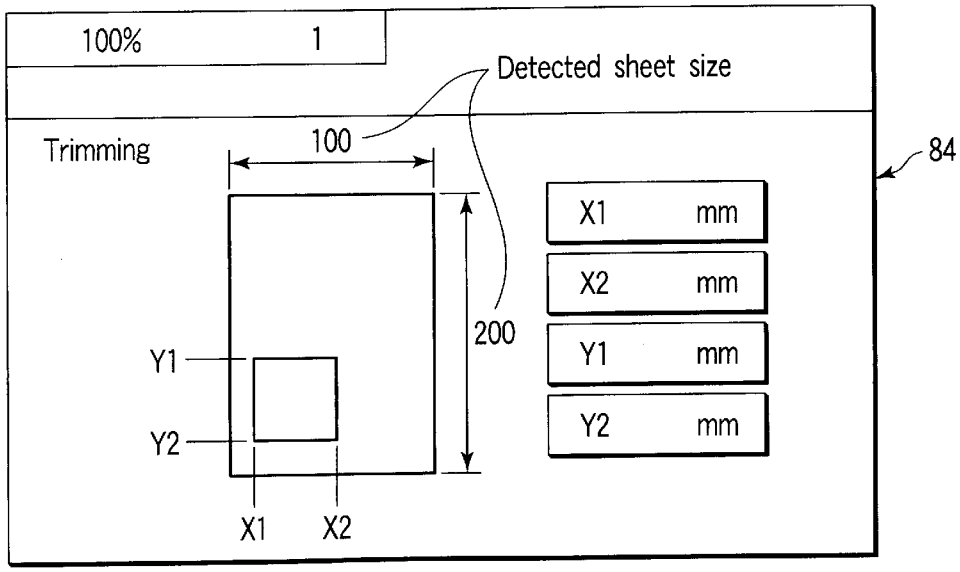
FIG. 8 shows an example of display on the liquid crystal display section at the time of processing an image.

FIG. 8 shows an example of display on the liquid crystal display section 84 at the time of image processing such as trimming or masking.

For example, when image processing for masking is performed as shown in FIG. 8, the main CPU 91 causes the liquid crystal display section 84 of operation panel 80 to display a reduced image of the detected sheet size (100 mm×200 mm in the Figure). Thereby, the displayed image can be used as a reference for image processing.

As has been described above, according to the embodiment of the present invention, the sheet size can be detected and set without increasing a machine body cost or imposing a load on a user.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus having a plurality of cassettes for containing paper sheets, and forming an image on a paper sheet fed from one of the cassettes, the apparatus comprising:

a designating section which designates the cassette in which a paper sheet for image formation by the image forming apparatus is to be set;

an image read section which reads an image of the paper sheet to be set in the cassette designated by the designating section, when said paper sheet is placed on an original table; and a control section which executes a control to detect the size of the paper sheet on the basis of the image read by the image read section and causes a display section provided on an operation panel of the image forming apparatus to display the detected size of the paper sheet, wherein the control section causes a display section provided on the cassette designated by the designating section to display the detected size of the paper sheet.

2. An image forming apparatus according to claim 1, wherein the control section detects the size of the paper sheet on the basis of a difference in density of the image read by the image read section.

3. An image forming apparatus according to claim 1, wherein the control section feeds the paper sheet from the cassette designated by the designating section and forms an image on the paper sheet in accordance with an instruction of image formation of the sheet size, when the paper sheet has been set in the cassette designated by the designating section.

4. An image forming apparatus having a plurality of cassettes for containing paper sheets, and forming an image on a tab sheet fed from one of the cassettes, the apparatus comprising:

a designating section which designates the cassette in which a tab sheet for image formation by the image forming apparatus is to be set;

an image read section which reads an image of the tab sheet to be set in the cassette designated by the designating section, when said tab sheet is placed on an original table; and a control section which causes the display section provided on the operation panel of the image forming apparatus to display the shape of the tab sheet, and detects the size of a tab section of the tab sheet.

5. An image forming apparatus according to claim 4, wherein the control section controls a shift of an image formation position on the tab sheet in accordance with the shape of the tab sheet.

6. An image forming apparatus having a plurality of cassettes for containing paper sheets, and forming an image on a paper sheet fed from one of the cassettes, the apparatus comprising:

a designating section which designates the cassette in which a paper sheet for image formation by the image forming apparatus is to be set;

an image read section which reads an image of the paper sheet to be set in the cassette designated by the designating section, when said paper sheet is placed on an original table; and a control section which executes a control to detect the size of the paper sheet on the basis of the image read by the image read section and causes a display section provided on an operation panel of the image forming apparatus to display the detected size of the paper sheet, wherein the control section causes the display section to display the cassette in which the paper sheet for image formation by the image forming apparatus is to be set and a sheet size detected at a display cassette which corresponds to the cassette designated by the designating section.

7. An image forming apparatus according to claim 6, wherein the control section detects the size of the paper sheet on the basis of a difference in density of the image read by the image read section.

8. An image forming apparatus according to claim 6, wherein the control section feeds the paper sheet from the cassette designated by the designating section and forms an image on the paper sheet in accordance with an instruction of image formation of the sheet size, when the paper sheet has been set in the cassette designated by the designating section.

* * * * *